US005680718A

United States Patent [19]

Ratcliffe et al.

[11] Patent Number: 5,680,718

[45] Date of Patent: Oct. 28, 1997

[54] ILLUMINABLE HAT

[75] Inventors: William R. Ratcliffe, Thousand Oaks, Calif.; William Blake Ratcliffe, Berwick, Canada; Erik Loose, Thousand Oaks, Calif.

[73] Assignee: First Choice Trading Limited, Kowloon, Hong Kong

[21] Appl. No.: 360,216

[22] Filed: Dec. 20, 1994

[51] Int. Cl.[6] ..... G09F 3/00; F21L 15/14

[52] U.S. Cl. ..... 40/329; 40/546; 2/195.1; 2/906; 362/106; 362/806

[58] Field of Search ..... 40/329, 546, 547, 40/714; 362/31, 103, 105, 106, 806; 2/195.1, 906, 209.12

[56] References Cited

U.S. PATENT DOCUMENTS

| | | |
|---|---|---|
| 993,251 | 5/1911 | Howard . |
| 1,597,823 | 8/1926 | Randolph . |
| 1,908,662 | 5/1933 | Geier . |

(List continued on next page.)

FOREIGN PATENT DOCUMENTS

| | | | |
|---|---|---|---|
| 570614 | 9/1958 | Belgium . | |
| 0121026 | 10/1984 | European Pat. Off. . | |
| 0335467 | 10/1989 | European Pat. Off. . | |
| 713490 | 3/1931 | France . | |
| 1555306 | 1/1969 | France . | |
| 2227714 | 11/1974 | France . | |
| 2556190 | 6/1985 | France . | |
| 2608485 | 9/1977 | Germany . | |
| 2838770 | 3/1980 | Germany . | |
| 3343897 | 6/1985 | Germany . | |
| 489219 | 1/1954 | Italy . | |
| 58-195238 | 11/1983 | Japan . | |
| 8006456 | 6/1982 | Netherlands . | |
| 333470 | 8/1930 | United Kingdom | 362/106 |
| 444392 | 3/1936 | United Kingdom . | |
| 1092482 | 11/1967 | United Kingdom . | |
| WO81/02223 | 8/1981 | WIPO . | |
| WO87/02846 | 5/1987 | WIPO . | |

OTHER PUBLICATIONS

Matsui et al, "Biomechanics VIII–B," *International Series on Biomechanics*, vol. 4B, 1983, pp. 1089–1096.

Miyazaki et al, "Foot–Force Measuring Device For Clinical Assessment . . . ," *Medical & Biological Engineering & Computing*, Jul. 1978, pp. 429–435.

Cheskin et al, *The Complete Handbook of Athletic Footwear*, 1987, pp. 156 & 158.

*Primary Examiner*—Peter M. Cuomo
*Assistant Examiner*—James O. Hansen
*Attorney, Agent, or Firm*—Ellsworth R. Roston; Thomas A. Runk

[57] ABSTRACT

The front end of a body portion on a hat (e.g. cap) may be continuous and the rear end may have separable sections. The hat may have a visor to form a cap defined by two (2) cloth layers separated by a backing member (e.g. cardboard). The backing member and the visor lower layer may have matching apertures to receive a module defined by a container and a cover pivotable on the container between open and closed positions. A switch, a battery and a printed circuit board may be disposed in the container. The switch may be manually closed, with the container closed, to energize electrical circuitry on the board. Such energizing may illuminate a member (e.g. LED) preferably disposed on the body portion and optically coupled to a display member to illuminate an individual design on the display member. The display member may be attached to the continuous front external surface of the body portion. Alternatively, the hat may have a band on the internal surface of the body portion. A switch on the band may become automatically closed to illuminate the LED when the body portion is disposed on a wearer's head. Straps on the separable rear sections of the body portion may converge the rear sections when detents on these sections are engaged. A member (e.g. another LED) on one of the straps may become illuminated by the switch closure to illuminate such strap. The strap may illuminate a design on a display member optically coupled to such strap.

11 Claims, 7 Drawing Sheets

U.S. PATENT DOCUMENTS

| | | | |
|---|---|---|---|
| 1,933,243 | 10/1933 | Merolis et al. . | |
| 2,203,028 | 6/1940 | Parrillo | 40/329 X |
| 2,258,543 | 10/1941 | Cressaty . | |
| 2,347,665 | 2/1944 | Christensen et al. . | |
| 2,480,800 | 8/1949 | Wickwire . | |
| 2,557,663 | 6/1951 | Knode . | |
| 2,572,760 | 10/1951 | Rikelman . | |
| 2,580,258 | 12/1951 | Tarasuk . | |
| 2,691,159 | 10/1954 | Heibel . | |
| 2,849,819 | 9/1958 | Murphy et al. . | |
| 2,854,563 | 9/1958 | Catching . | |
| 2,931,012 | 3/1960 | Kosach . | |
| 2,931,893 | 4/1960 | Arias et al. . | |
| 3,008,038 | 11/1961 | Dickens et al. . | |
| 3,070,907 | 1/1963 | Rocco . | |
| 3,239,696 | 3/1966 | Burkhalter et al. . | |
| 3,323,367 | 6/1967 | Searle . | |
| 3,328,570 | 6/1967 | Balchunas . | |
| 3,349,511 | 10/1967 | Aronoff . | |
| 3,363,139 | 1/1968 | Schiavone . | |
| 3,383,503 | 5/1968 | Montgomery . | |
| 3,435,556 | 4/1969 | Clarke . | |
| 3,549,878 | 12/1970 | Bailey . | |
| 3,580,575 | 5/1971 | Speeth . | |
| 3,582,691 | 6/1971 | Sonderegger . | |
| 3,582,692 | 6/1971 | Palini . | |
| 3,604,958 | 9/1971 | Palini . | |
| 3,610,916 | 10/1971 | Meehan . | |
| 3,701,903 | 10/1972 | Merhar . | |
| 3,720,918 | 3/1973 | Perl . | |
| 3,737,647 | 6/1973 | Gomi . | |
| 3,750,127 | 7/1973 | Ayers et al. . | |
| 3,769,663 | 11/1973 | Perl . | |
| 3,798,474 | 3/1974 | Cassand et al. . | |
| 3,800,133 | 3/1974 | Duval . | |
| 3,808,418 | 4/1974 | Conard et al. . | |
| 3,828,177 | 8/1974 | Day . | |
| 3,893,247 | 7/1975 | Dana, III . | |
| 3,931,514 | 1/1976 | Patterson . | |
| 3,940,868 | 3/1976 | Northcutt . | |
| 3,946,505 | 3/1976 | Dana, III . | |
| 3,947,676 | 3/1976 | Battilana et al. . | |
| 3,967,142 | 6/1976 | Beach . | |
| 3,974,491 | 8/1976 | Sipe . | |
| 4,014,115 | 3/1977 | Reichert . | |
| 4,020,572 | 5/1977 | Chiaramonte, Jr. . | |
| 4,054,808 | 10/1977 | Tanaka . | |
| 4,064,429 | 12/1977 | Boehm . | |
| 4,112,601 | 9/1978 | Chiaramonte, Jr. . | |
| 4,128,861 | 12/1978 | Pelengaris . | |
| 4,130,951 | 12/1978 | Powell . | |
| 4,158,117 | 6/1979 | Quilliam et al. . | |
| 4,158,922 | 6/1979 | Dana, III . | |
| 4,164,008 | 8/1979 | Miller et al. . | |
| 4,185,621 | 1/1980 | Morrow . | |
| 4,216,403 | 8/1980 | Krempl et al. . | |
| 4,231,079 | 10/1980 | Heminover . | |
| 4,231,169 | 11/1980 | Toyama et al. . | |
| 4,250,650 | 2/1981 | Fima . | |
| 4,253,253 | 3/1981 | McCormick . | |
| 4,298,917 | 11/1981 | Ware . | |
| 4,304,126 | 12/1981 | Yelke . | |
| 4,328,441 | 5/1982 | Kroeger, Jr. et al. . | |
| 4,347,681 | 9/1982 | Fima . | |
| 4,367,515 | 1/1983 | Beard . | |
| 4,402,147 | 9/1983 | Wu . | |
| 4,406,040 | 9/1983 | Cannone . | |
| 4,423,473 | 12/1983 | Kirkley . | |
| 4,451,871 | 5/1984 | Kirkley et al. . | |
| 4,473,870 | 9/1984 | Sorenson . | |
| 4,480,293 | 10/1984 | Wells . | |
| 4,499,394 | 2/1985 | Koal . | |
| 4,510,704 | 4/1985 | Johnson . | |
| 4,523,258 | 6/1985 | Morse et al. . | |
| 4,523,261 | 6/1985 | West . | |
| 4,525,878 | 7/1985 | Lowe, Jr. | 2/195.1 X |
| 4,570,206 | 2/1986 | Deutsch . | |
| 4,595,200 | 6/1986 | Shishido . | |
| 4,595,864 | 6/1986 | Stiefelmeyer et al. . | |
| 4,599,682 | 7/1986 | Stephens . | |
| 4,602,191 | 7/1986 | Davila . | |
| 4,660,305 | 4/1987 | Medler et al. . | |
| 4,665,568 | 5/1987 | Stutes . | |
| 4,667,274 | 5/1987 | Daniel . | |
| 4,703,217 | 10/1987 | Ratzlaff et al. . | |
| 4,729,068 | 3/1988 | Ohe . | |
| 4,737,134 | 4/1988 | Rumsey . | |
| 4,741,120 | 5/1988 | Cota et al. . | |
| 4,748,366 | 5/1988 | Taylor . | |
| 4,771,394 | 9/1988 | Cavanagh . | |
| 4,774,434 | 9/1988 | Bennion . | |
| 4,774,642 | 9/1988 | Janko et al. . | |
| 4,777,749 | 10/1988 | Leo, Sr. . | |
| 4,779,166 | 10/1988 | Tanaka et al. . | |
| 4,791,539 | 12/1988 | Ewing . | |
| 4,811,507 | 3/1989 | Blanchet . | |
| 4,814,661 | 3/1989 | Ratzlaff et al. . | |
| 4,824,107 | 4/1989 | French . | |
| 4,827,384 | 5/1989 | Von Schlemmer . | |
| 4,839,777 | 6/1989 | Janko et al. . | |
| 4,848,009 | 7/1989 | Rodgers . | |
| 4,875,144 | 10/1989 | Wainwright . | |
| 4,896,069 | 1/1990 | Rosenberg et al. . | |
| 4,901,211 | 2/1990 | Shen . | |
| 4,904,222 | 2/1990 | Gastgeb et al. . | |
| 4,935,851 | 6/1990 | Wood . | |
| 4,937,709 | 6/1990 | Yanagi et al. . | |
| 4,943,752 | 7/1990 | Todd et al. . | |
| 4,945,458 | 7/1990 | Batts et al. . | |
| 4,959,761 | 9/1990 | Critelli et al. . | |
| 4,975,809 | 12/1990 | Ku . | |
| 4,985,809 | 1/1991 | Matsui et al. . | |
| 4,991,068 | 2/1991 | Mickey . | |
| 4,991,150 | 2/1991 | Wixom . | |
| 4,998,186 | 3/1991 | Cocca . | |
| 5,019,438 | 5/1991 | Rapisarda . | |
| 5,033,212 | 7/1991 | Evanyk . | |
| 5,034,648 | 7/1991 | Gastgeb . | |
| 5,052,131 | 10/1991 | Rondini . | |
| 5,057,974 | 10/1991 | Mizobe . | |
| 5,088,127 | 2/1992 | Thornock | 2/906 X |
| 5,111,366 | 5/1992 | Rife et al. . | |
| 5,113,325 | 5/1992 | Eisenbraun . | |
| 5,128,842 | 7/1992 | Kenmochi . | |
| 5,128,843 | 7/1992 | Guritz . | |
| 5,134,549 | 7/1992 | Yokoyama . | |
| 5,147,129 | 9/1992 | Ku . | |
| 5,151,679 | 9/1992 | Dimmick . | |
| 5,158,767 | 10/1992 | Cohen et al. . | |
| 5,177,812 | 1/1993 | DeMars . | |
| 5,178,447 | 1/1993 | Murase et al. . | |
| 5,188,447 | 2/1993 | Chiang et al. . | |
| 5,199,780 | 4/1993 | Ekman . | |
| 5,207,493 | 5/1993 | Murase et al. . | |
| 5,239,450 | 8/1993 | Wall . | |
| 5,245,516 | 9/1993 | de Haas et al. . | |
| 5,249,104 | 9/1993 | Mizobe . | |
| 5,249,106 | 9/1993 | Barnes et al. . | |
| 5,278,733 | 1/1994 | St. Thomas . | |
| 5,278,734 | 1/1994 | Ferber . | |
| 5,283,673 | 2/1994 | Murase et al. . | |
| 5,283,722 | 2/1994 | Koenen et al. . | |

5,283,911 2/1994 DeMars .
5,283,968 2/1994 Williams .
5,285,586 2/1994 Goldston et al. .
5,303,131 4/1994 Wu .
5,323,492 6/1994 DeMars .
5,329,637 7/1994 Walker .
5,404,593 4/1995 Kronenberger ..... 362/106 X
5,485,358 1/1996 Chien ..... 362/106
5,508,900 4/1996 Norman ..... 362/106
5,510,961 4/1996 Peng ..... 362/106

FIG. 7
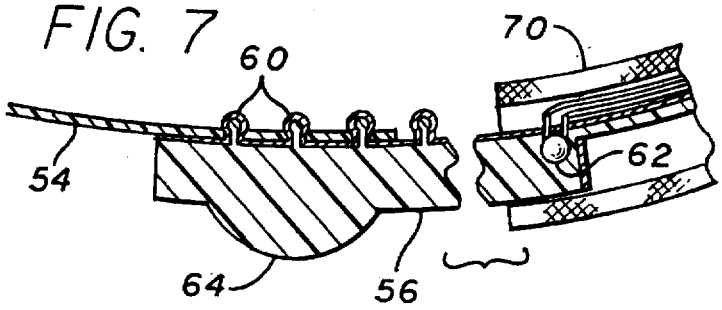
FIG. 8
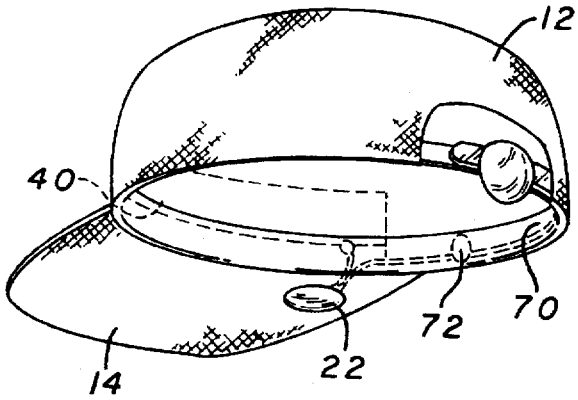
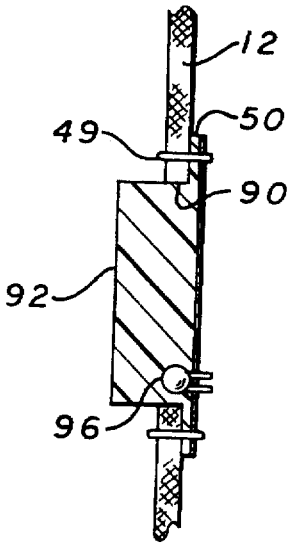
FIG. 11
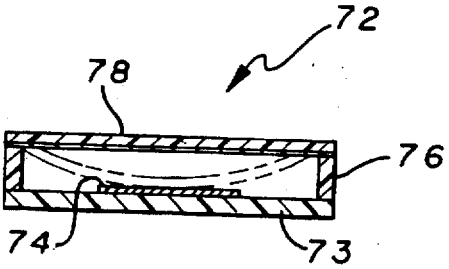
FIG. 9
FIG. 10
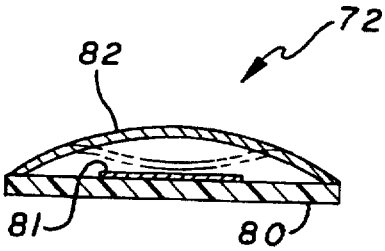

FIG. 12
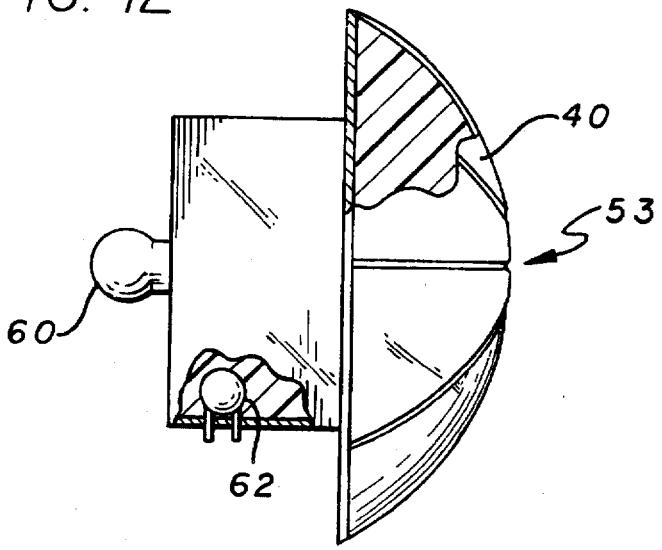
FIG. 15
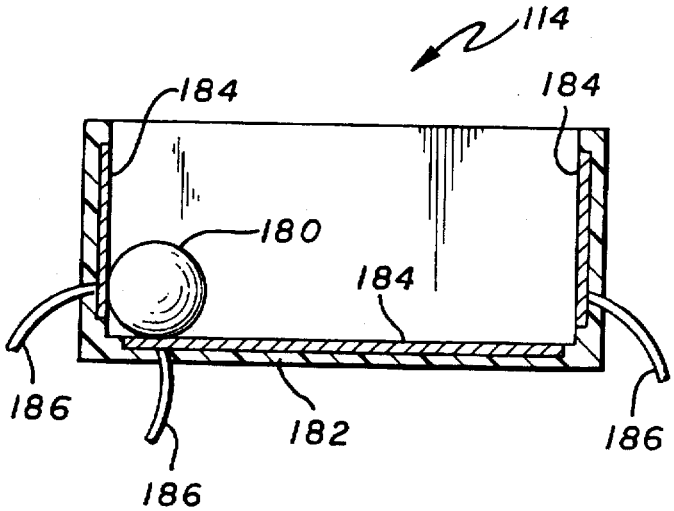
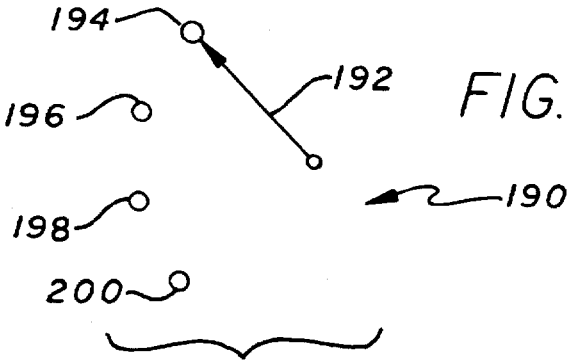
FIG. 16

FLASH TIMER

ILLUMINABLE HAT

This invention relates to hats which can become illuminated to display individual designs.

Hats are worn for a number of different reasons. For example, hats are worn to provide warmth to a wearer's head. Hats are also worn, particularly by women, for aesthetic reasons. Hats are also worn to display messages. For example, hats are worn to indicate loyalties to individual teams in a number of different sports, both at the amateur and professional levels.

When the hats are provided with visors, they are known as caps. The caps offer certain advantages relative to caps. The visors protect the wearer against the effects of sunshine. This provides the wearer with an opportunity to view into the sun. It also protects the wearer from a health standpoint against the effects of the sun. For example, it protects the wearer against skin cancers. It also protects the wearer against skin dryness and skin wrinkles. Caps with the insignia of baseball teams are especially popular since the same types of hats are worn by the players on such baseball teams.

It has been known for some time that illuminable hats, and particularly illuminable caps, are desirable. For example, it has been known for some time that caps illuminable to display the logos of baseball teams would be desirable. Such illuminable caps are desirable because they display team loyalty and display sociability. A significant number of attempts have been made, and considerable amounts of money have been expended, to provide such hats. Such attempts have not been successful.

One reason for the lack of success is that the hardware for providing such illuminated displays has been cumbersome and bulky. This has negatively affected the appearance of the caps. Another reason is that the caps have not been able to provide such illumination for extended periods of time because of excessive and unnecessary expenditure of power. A third reason is that the displays provided on the cap have not been capable of being provided on the cap in an aesthetic relationship. A fourth reason is that the caps have been provided with such complex electrical and optical arrangements that the caps have been expensive. This has prevented the caps from enjoying a large market.

This invention provides an illuminable cap or hat which overcomes the disadvantages discussed above. The invention provides the illuminable features on a cap or hat in a compact arrangement that does not affect the appearance of the cap. In other words, a viewer cannot tell from the appearance of the cap or hat that the cap is illuminable until the cap or hat is actually illuminated. The cap or hat of this invention can be illuminated for extended periods of time without having to replace any components, including the battery, in the cap or hat. The electrical and optical arrangements in the cap are direct and simple so that the price of the cap is affordable on a mass distribution basis. The aesthetic appearance of the individual design on the cap or hat, when illuminated, is highly aesthetic.

In one embodiment of the invention, a body portion on a hat may be continuous at the front end and may have separable sections at the rear end. The hat may have a visor to form a cap defined by two (2) cloth layers separated by a backing member (e.g. cardboard). The backing member and the lower layer of the visor may have matching apertures to receive a module defined by a container and a cover pivotable on the container between open and closed positions.

A switch, a battery and a printed circuit board may be disposed in the container. The switch may be manually closed, with the container closed, to energize electrical circuitry on the printed circuit board. Such energizing may illuminate a member (e.g. LED) preferably disposed on the body portion and optically coupled to a display member to illuminate an individual design on the display member. The display member may be attached to the continuous front external surface of the body portion.

Alternatively, the hat may have a band on the internal surface of the body portion. A switch on the band may become automatically closed to illuminate the LED when the body portion is disposed on a wearer's head.

Straps on the separable rear sections of the body portion may converge the rear sections when detents on these sections are engaged. A member (e.g. another LED) on one of the straps may become illuminated by the switch closure to illuminate such strap. The strap may illuminate a design on a display member optically coupled to such strap.

In the drawings:

FIG. 7 is an enlarged fragmentary sectional view showing the arrangement at the rear end of the cap in additional detail;

FIG. 8 is a perspective view of another embodiment of a cap included in this invention;

FIG. 9 is an enlarged sectional view of one type of switch that may be included in the embodiment shown in FIG. 8;

FIG. 10 is an enlarged sectional view of another type of switch that may be included in the embodiment shown in FIG. 8;

FIG. 11 is a fragmentary sectional view of a modification of the embodiment shown in FIGS. 2–4;

FIG. 12 is a fragmentary sectional view, similar to that shown in FIG. 11, of another modification of the embodiment shown in FIGS. 2–4;

FIG. 15 is a schematic view of one embodiment of a switch which is included in the circuitry shown in FIGS. 13 and 14;

FIG. 16 is a schematic perspective view of another switch which can be used in combination with the circuitry shown in FIGS. 13 and 14 and the switch shown in FIG. 15 to implement the operation of the circuitry in individual ones of a plurality of different modes.

Figure 1:
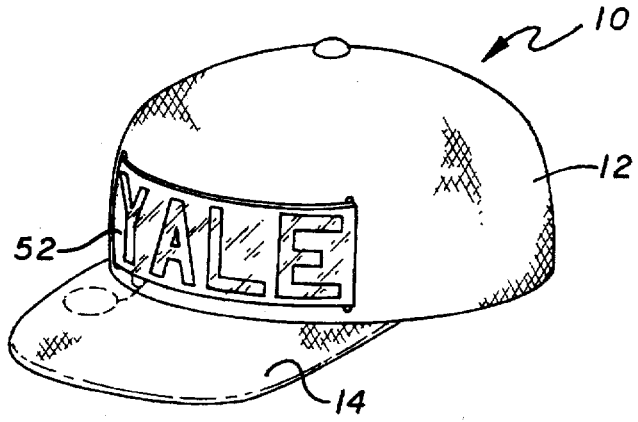
FIG. 1 is a perspective view of a cap constituting one embodiment of the invention.

In one embodiment of the invention, a hat generally indicated at 10 is provided. The hat includes a body portion 12 for disposition on the head of a wearer. The hat 10 may also include a visor 14 which extends from the body portion 12 at the front of the body portion. The visor 14 may have top and bottom layers 16*a* and 16*b* (FIGS. 2 and 3) separated from each other by a backing member 18. The backing member 18 may be made from a suitable material such as cardboard to impart a stiffness to the visor 14.

The lower layer 16*a* of the visor 14 and the backing member 18 may be respectively provided with apertures 20 and 21 to receive a module generally indicated at 22. The module 22 may be defined by a container 24 and a cover 26, both preferably made from an electrically insulating material such as a plastic material. The cover 26 may be pivotably attached as at 28 to the container 24 at one side of the container for movement between open and closed positions. In the closed position, the cover is releasably attached as at 30 to the container to define a clasp so that the container and the cover can remain closed when it is so desired. However, it will be appreciated that the cover 26 may be sealed to the container 24 rather than being pivotably attached to the container.

Various components and sub-assemblies are retained in the container 24 in a press-fit relationship with the container. These include a battery 32 and a switch 34. The battery 32 may be a lithium type of battery well known in the art. The battery has two (2) terminals 32*a* (FIGS. 2 and 3) and 32*b* each having a different radius than the other. The terminal 32*a* is contacted as by a conductive leaf spring 33 which may provide an electrical ground. The switch 34 may be normally in the open state and may be actuated to the closed state by manually grasping the bottom and top layers 16*a* and 16*b* of the visor 14 and by pressing these layers toward each other. Although the leaf spring 33 is shown at or near the upper surface of the cap visor, it will be appreciated that the leaf spring may be disposed at or near the lower surface of the cap visor.

Figure 4:
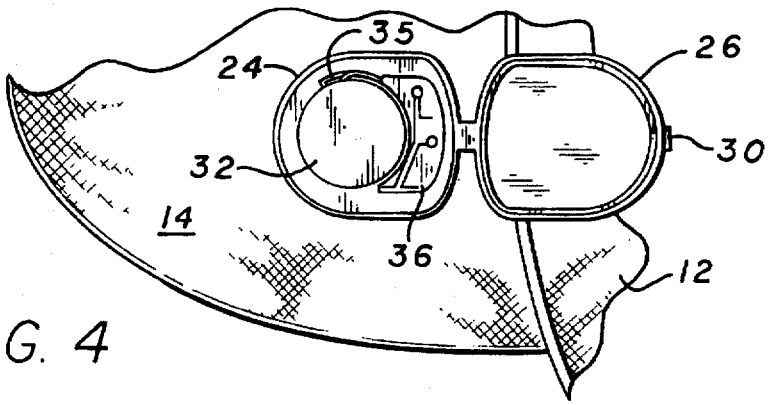
FIG. 4 is a plan view of the module shown in FIGS. 2 and 3 with the cover in the open relationship.

A printed circuit board 36 may be also disposed in the container 24. The printed circuit board 36 includes a conductive leaf spring 35 (FIGS. 3 and 4) which contacts the terminal 32*b* of the battery 32 preferably at the annular peripheral edge of the terminal. The arrangement of the battery 32 and the leaf springs 33 and 35 is shown and described in additional detail in co-pending application Ser. No. 08/190,310 filed on Feb. 2, 1994 by William R. Ratcliffe for an "Illuminating System" and assigned of record to the assignee of record of this application.

Figure 3:
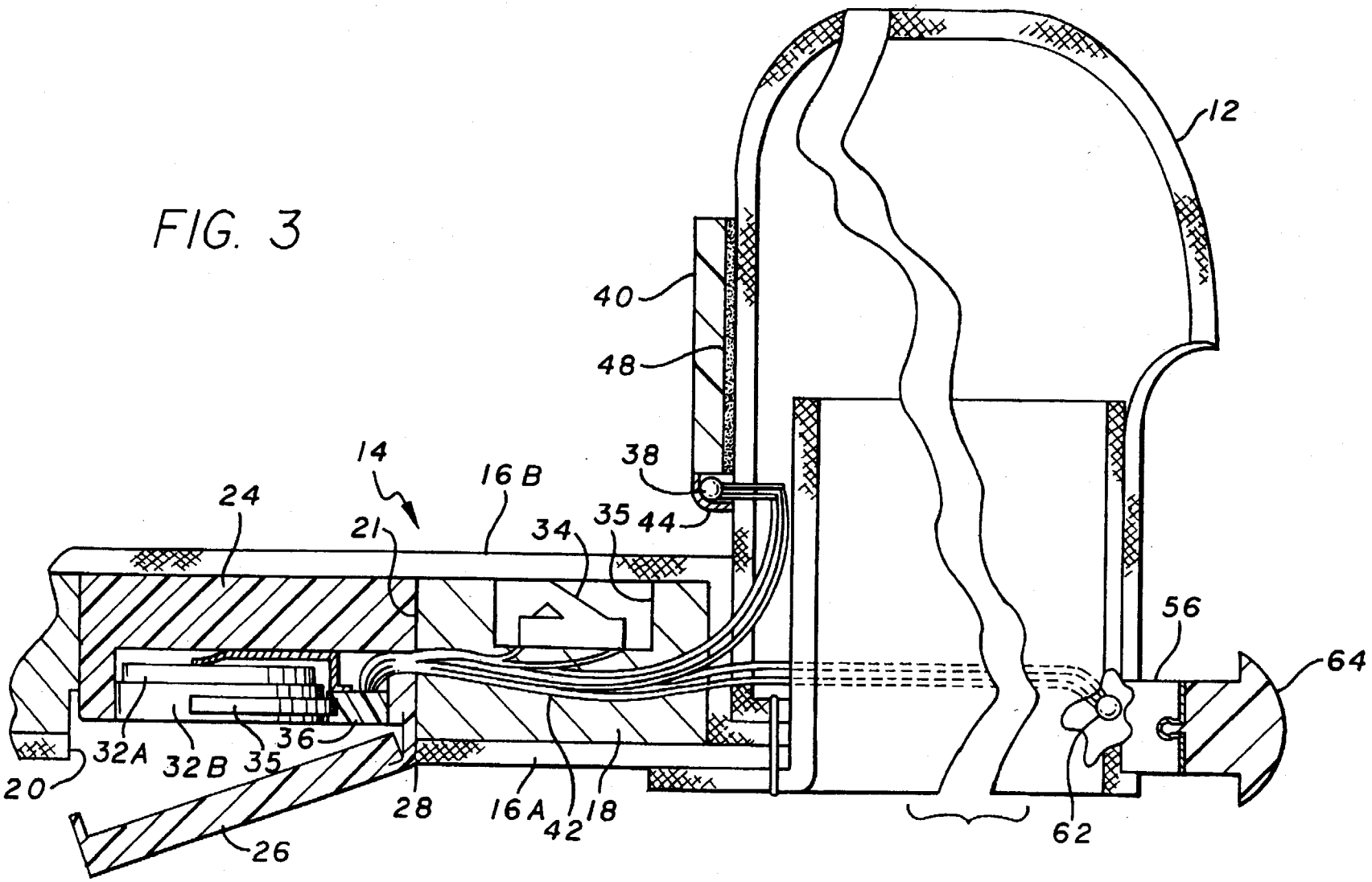
FIG. 3 is a sectional view similar to that shown in FIG. 2 but shows a switch in a different position from that shown in FIG. 2 and also shows a cover for a module in an open relationship.
Figure 13:
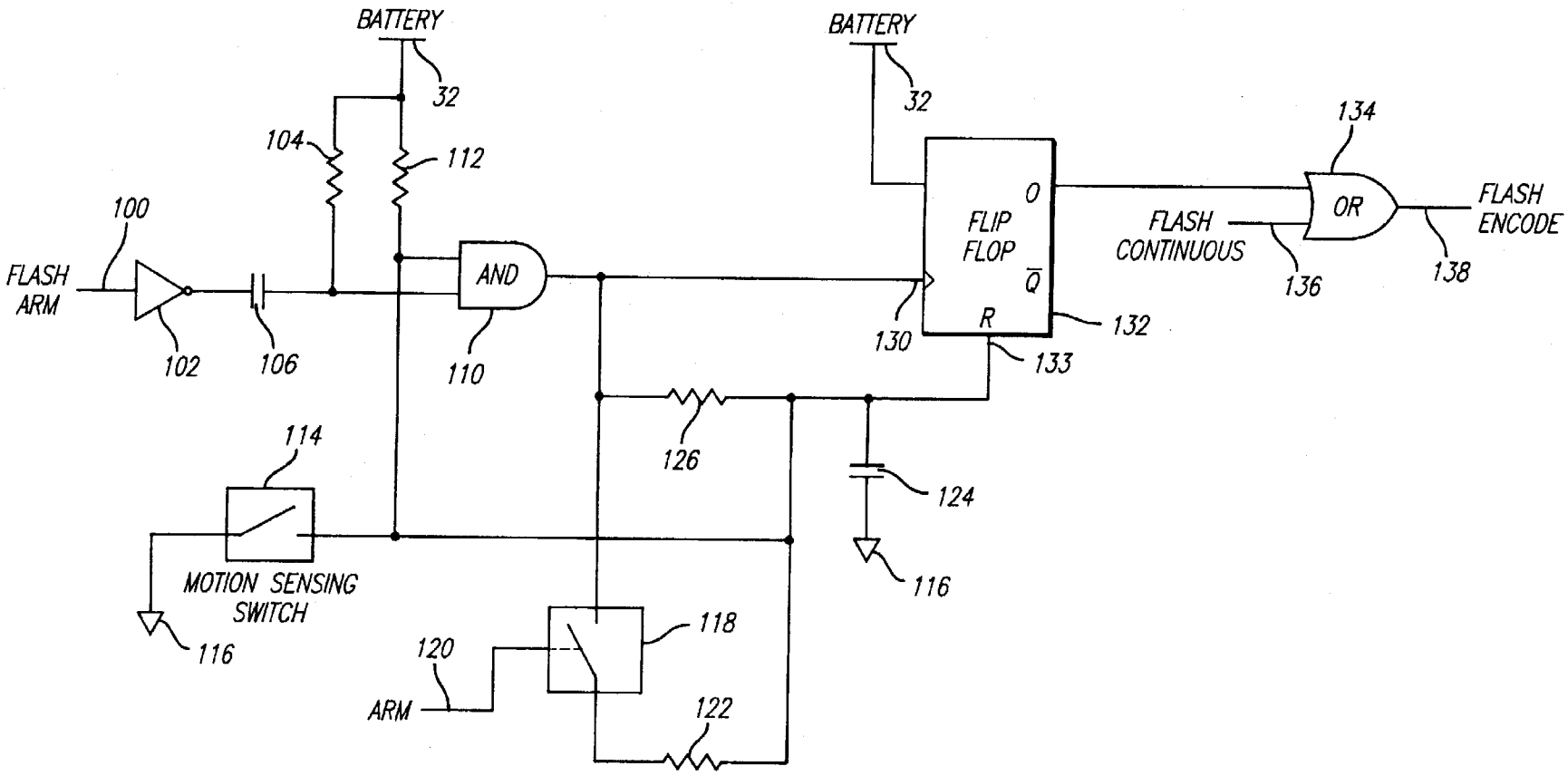
FIG. 13 is a diagram of electrical circuitry which can be used with any of the embodiments shown in the previous Figures to provide a number of different modes of operation.
Figure 14:
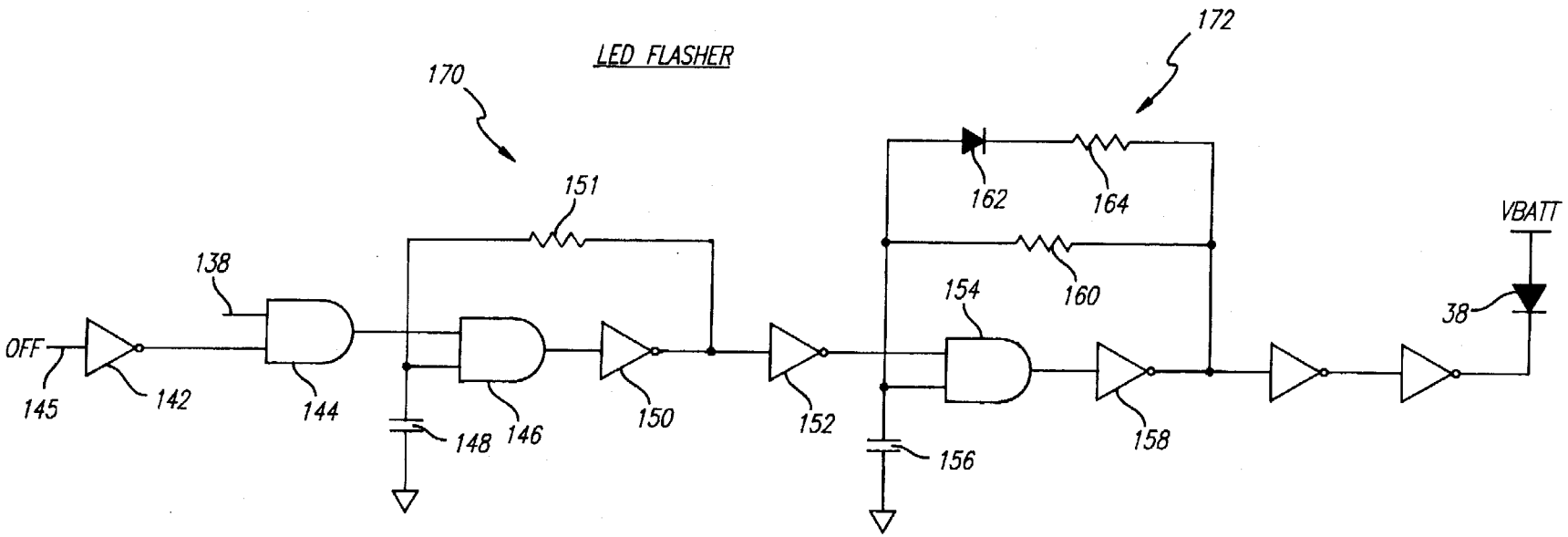
FIG. 14 is a diagram of additional electrical circuitry for use with the electrical circuitry shown in FIG. 13 for providing periodic flashes of light in display members on the caps shown in FIGS. 1–12.

The printed circuit board 36 may hold electrical circuitry shown in additional detail in FIGS. 13 and 14. Alternatively, the switch 34 may be displaced from the module 22 as shown in FIG. 3. In the embodiment shown in FIG. 3, the switch may be disposed in a socket 35 in the backing member 18.

An illuminating member such as a light emitting diode (LED) 38 is preferably disposed on the exterior surface of the body portion 12. Wires indicated at 42 connect the switch 34, the battery 32, the printed circuit board 36 and the light emitting diode 38. As will be seen, the wires 42 extend through the body portion 12 to the light emitting diode 38 from the printed circuit board 36.

A display member 40 may be optically coupled to the light emitting diode 38 as by edge lighting. This coupling may be provided by disposing the light emitting diode 38 in contiguous relationship to the display member 40 and by enveloping the diode in a material 44 which provides for the passage of light substantially only from the diode. The display member 40 is preferably constructed from a suitable material such as a clear polyurethane so as to become illuminated when the light emitting diode 38 is illuminated.

The display member 40 is suitably attached to a continuous exterior surface at the front of the body portion 12. The attachment may be as by an adhesive 48 (FIGS. 2 and 3) or by threads 49 (FIG. 12) extending through the body portion and disposed around the display member at flanges 50 on the periphery of the display member. In the embodiment shown in FIG. 1, the design 52 is illustratively illustrated as "YALE", one of the leading universities in the United States. The design may be formed in a three-dimensional relationship 53 (FIG. 12) on the display member 40 and may be enhanced by dark lines on the surface of the display member. This causes the design on the display member 40 to become emphasized when the display member becomes illuminated.

The embodiment shown in FIGS. 1–4 has certain important advantages. All of the electrical components are disposed within the module 22 in a pressed-fit relationship. The module may illustratively have a diameter of less than one inch (1"). Furthermore, the module 22 is disposed on the bottom layer 16*a* of the visor 14 in a recessed relationship within the apertures 21 and 20 respectively in the bottom layer of the visor and in the backing member 18. This prevents the module 22 from being seen except on a close inspection of the cap 10. This causes the module 22 to have a compact disposition which does not affect the normal appearance of the cap 10. The display member 40 is also disposed on the front exterior surface of the cap 10. This enhances the visual effect of the design 52 on the display member when the display member 40 is illuminated.

Figure 5:
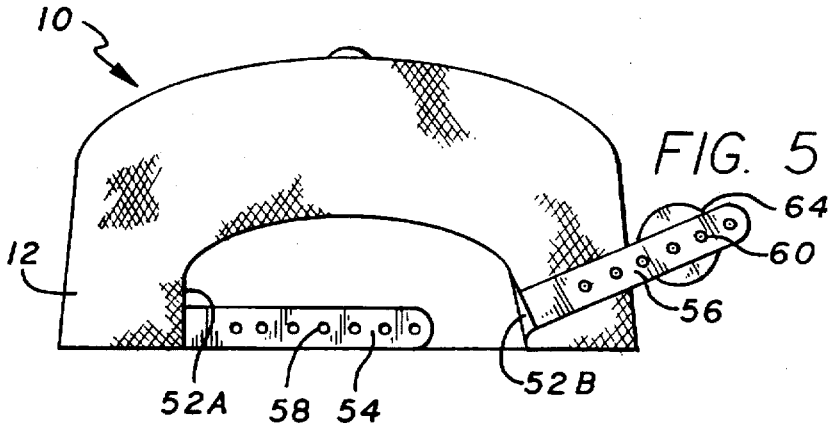
FIG. 5 is a rear elevational view of the cap shown in FIG. 1 with a pair of straps at the rear in an unclasped relationship.
Figure 6:
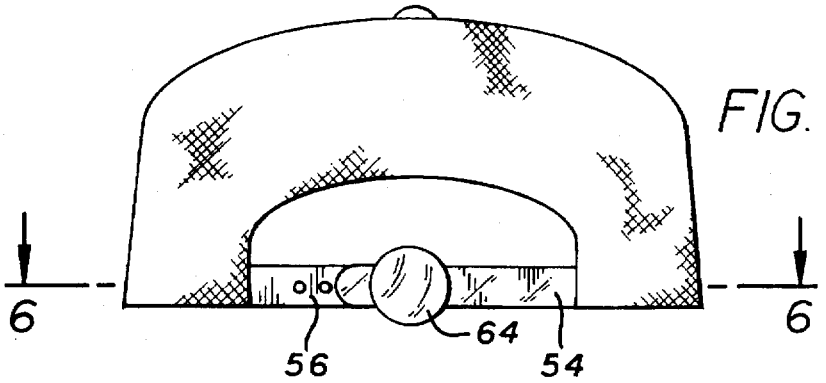
FIG. 6 is a rear elevational view similar to that shown in FIG. 2 with the straps in a clasped relationship.

An illuminable display generally indicated at 50 in FIGS. 5–7 may be also provided at the rear end of the hat or cap 10. As shown in FIGS. 5–7, the rear end of the body portion 12 may be provided with two (2) separable portions 52*a* and 52*b*. Straps indicated at 54 and 56 may be respectively provided on the separable portions 52*a* and 52*b*. The strap 54 may be formed from a suitable material such as an opaque plastic or cloth and may be provided with female detents such as holes 58 progressively spaced along the length of the strap.

The strap 56 may be formed from a clear plastic material such as a polystyrene so as to have properties of becoming illuminated. The strap 56 may be provided with plurality of male detents such as pegs 60 spaced at progressive distances along the length of the strap. An illuminable member such as a light emitting diode (LED) 62 may be disposed on the strap 56. The light emitting diode 62 may be connected electrically to the printed circuit board 36 when the switch 34 becomes closed. A display member 64 may be optically coupled on the strap 56 to the light emitting diode 62. The display member 64 may be constructed in a manner similar to that described above for the display member 40. The display member 64 is shown as having a simplified three (3)-dimensional construction.

The size of the body portion 12 may be adjusted by selecting an individual one of the pegs 60 on the strap 56 to be disposed in an individual one of the holes 58 on the strap 54. Furthermore, the display member 64 may be illuminated at the same time as the display member 40 is illuminated. This is accomplished by closing the switch 34. It will be appreciated, however, that the display member 64 may be illuminated independently of the illumination of the display member 40 by providing an additional switch and an additional printed circuit board which are associated only with the light emitting diode 62 and the display member 64.

A hat band 70 (FIG. 8) may be disposed on the interior surface of the body portion 12 at or near the bottom of the body portion. The hat band 70 may be constructed in a conventional manner. A switch generally indicated at 72 may be disposed on the hat band 70. The switch 72 may be provided instead of, or in addition to, the switch 34 to perform substantially the same functions as the switch 34. The switch 72 may be constructed to be closed automatically when the portion 12 is disposed on a wearer's head. The switch 72 may be constructed in a number of different ways well known in the art.

For example, the switch 72 may include a printed circuit board 73 (FIG. 9) with an electrical contact 74,a hollow spacer 76 and a conductive film 78 on the spacer in spaced relationship with the electrical contact 74. The film 78 is constructed to be pressed against the electrical contact 74 when the body portion 12 is disposed on the wearer's head. Alternatively, the switch 72 may constitute a capacitance switch in which a printed circuit board 80 with a contact 81 is separated from a capacitance plate 82. In this embodiment, capacitance value may be varied by varying the distance between the plate 82 and the printed circuit board when the body portion 12 is disposed on the wearer's head. The electrical circuitry becomes operative in accordance with the variation in the capacitance value.

The embodiments shown in FIGS. 8–10 have certain advantages over the prior art and even over the embodiment shown in FIGS. 1–4. For example, the switch 72 becomes automatically closed when the body portion 12 becomes disposed on the wearer's head and the switch 72 becomes automatically opened when the body portion 12 is removed from the wearer's head. Furthermore, all of the members for illuminating the display member 40 are disposed within the body portion 12 so that the only visible component is the display member 40 even upon a close inspection of the hat or cap 10.

FIG. 11 illustrates a modification of the embodiments shown in the previous figures. In this modification, the body portion 12 is provided with an aperture 90 and a display member 92 is provided with the flange 50. The flange 50 is disposed against the interior surface of the body portion 12 and a light emitting diode 96 is disposed within the display member 92.

It will be appreciated that different features may be shown in a single Figure for purposes of convenience. For example, FIG. 11 shows the flange 50, the threads 49 and the display member 92 with the light emitting diode 96 inside the display member. These features can be provided individually in different embodiments or can be combined selectively with individual ones of the features shown in the previous Figures. Different combinations can also be provided from individual components in a number of the other Figures.

FIGS. 13 and 14 show electrical circuitry on a simplified block diagram basis for use with the different embodiments discussed above. The circuitry shown in FIG. 13 includes a line 100 designated as "FLASH ARM". The signals on the line 100 are introduced to an amplifier-inverter 102. A resistor 104 and a capacitor 106 are in series between the battery 32 and the output terminal of the amplifier-inverter 102.

The common terminal between the capacitor 106 and the resistor 104 is connected to one input terminal of an AND network 110. A second input terminal of the AND network 110 is connected to a first terminal of a resistor 112, a second terminal of which is common with the battery 32. The first terminal of the resistor 112 is also common with a stationary contact of a motion sensing switch 114, the movable arm of which is at a reference potential such as a ground 116.

The output terminal of the AND network 110 is common with the stationary terminal of a switch 118 having its movable arm connected to a line 120 designated as ARM. The movable arm of the switch 116 is also connected through a resistor 122 to a terminal common to first terminals of a capacitor 124 and a resistor 126. The other terminal of the capacitor 124 is at the reference potential such as the ground 116. The other terminal of the resistor 126 is common with the output terminal of the AND network 110.

The output of the AND network 110 is introduced to one input terminal 130 of a flip-flop 132. A second input terminal of the flip-flop 132 is common with the battery 32. A reset terminal 133 (designated as R) has a common connection with the ungrounded terminal of the capacitor 124. An output terminal (designated as 0) of the flip-flop 132 is connected to one input terminal of an OR network 134 having a second input terminal connected to a line 136 designated as FLASH CONTINUOUS. An output line 138 common with the output terminal of the OR network 134 is designated as FLASH ENABLE.

The line 138 is also shown in FIG. 14. The line 138 is connected to an input terminal of an AND network 144. A line 145 (designated as OFF) is connected to the input of an amplifier-inverter 142, the output of which is introduced to a second input terminal of the AND network 144. The output of the AND network 144 is introduced to one input terminal of an AND network 146, another input terminal of which is common with an ungrounded terminal of a capacitor 148 and with the output terminal of an amplifier-inverter 150 through a resistor 151. The input terminal of the amplifier-inverter 150 receives the output of the AND network 146.

An amplifier-inverter 152 receives the output from the amplifier-inverter 150. The output of the amplifier-inverter 152 is introduced to an input terminal of an AND network 154 having another input terminal connected to an ungrounded terminal of a capacitor 156. The AND network 154 and an amplifier-inverter 158 are in series. A resistor 160 in one branch and a diode 162 and a resistor 164 in series in another branch are connected between the output terminal of the amplifier-inverter 158 and the ungrounded terminal of the capacitor 156. The output of the amplifier-inverter 158 is introduced through amplifier-inverters to one or more of the light-emitting diodes (e.g. 38, 62 and/or 92) in the previous Figures. FIG. 14 illustratively shows this light-emitting diode as the diode 38.

The circuitry shown in FIGS. 13 and 14 has four (4) different modes of operation. One of these is designated as FLASH ARM and is provided when a positive signal is provided on the line 100 in FIG. 13. This signal is inverted by the amplifier-inverter 102 to provide for a charging of the capacitor 106 from the battery 32. When the capacitor 106 becomes charged to a particular value, a positive signal passes through the AND network 110 and triggers the flip-flop 132 at the terminal 130. A positive signal accordingly passes through the OR network 134, the line 138 in FIGS. 13 and 14 and the AND network 144 in FIG. 14 to the AND network 146. The AND network is activated at this time because a low voltage on the line 145 (designated as OFF) is inverted by the amplifier-inverter 142 to provide for the introduction of a high voltage to the AND network 144.

The AND network 146, the capacitor 148, the amplifier-inverter 150 and the resistor 151 operate as an oscillator in a manner well known in the art. This oscillator is generally indicated at 170. The values of the different components in the oscillator 170 are chosen to have the oscillator operate at a relatively low frequency. The oscillator 170 is activated by the passage of a signal from the line 138 through the AND network 144 to the AND network 146.

The oscillator is de-activated at a subsequent time by the passage of a current through a circuit including the battery 32, the AND network 110, the resistor 126 and the capacitor 124 in FIG. 13 to charge the capacitor. When the capacitor 124 becomes charged to a particular voltage, the voltage at the reset terminal 133 in the flip-flop 132 becomes sufficiently positive to trigger the flip-flop. When the flip-flop 132 is triggered, the voltage introduced to the OR network 134 from the flip-flop becomes low. The low voltage from the OR network 134 causes the activation of the oscillator 170 to be discontinued. The oscillator 170 may have such a low frequency that only one (1) pulse may be produced in the oscillator during the time that the oscillator is activated.

The double inversion provided by the amplifier-inverters 150 and 152 in FIG. 14 causes a positive voltage to be introduced to the AND network 154 which is included with the amplifier-inverter 158, the resistors 160 and 164, the capacitor 156 and the diode 162 in an oscillator generally indicated at 172. The oscillator 172 has a considerably higher frequency than the oscillator 170. As a result, oscillations are produced in the light emitting diode 38 (as shown in FIG. 14 and in the light emitting diodes 62 and 92) during the limited period of time that the oscillator 170 is activated.

As previously described, the flip-flop 132 (FIG. 13) is reset when the capacitor 124 is charged to a particular value. However, if the wearer moves his or her head before the flip-flop 132 becomes reset, the motion-sensing switch 114 becomes closed. This causes the capacitor 124 to discharge through the switch 114. As a result, the flip-flop 132 is prevented from becoming reset so that the oscillations continue. Additional movements of the head before the resetting of the flip-flop 132 at the terminal 133 provide for discharges of the capacitance 124 and the production of continued oscillations.

Motion sensing switches such as the switch 184 are well known in the art. A somewhat simplistic embodiment of the switch 114 is shown in FIG. 15. In this embodiment, a conductive ball 180 is shown as being movable on a conductive platform 182. When the hat wearer moves his or her head with the body portion 12 on the head, the ball 180 moves along the platform 182 to a conductive periphery 184 which is separated electrically from the platform 182. The ball 180 bridges the platform 182 and the periphery 184 to close the switch 114. Electrical leads 186 are connected to the platform 182 and the periphery 184.

Another mode of operation in the circuitry of FIGS. 13 and 14 is designated as FLASH CONTINUOUS. This mode of operation is provided by a signal on the line 136 in FIG. 13. This signal is introduced through the OR network 134 and the FLASH ENCODE line 138 (FIGS. 13 and 14) to the oscillator 170 in FIG. 14 to provide oscillations at a low frequency. During each positive pulse of such oscillations, the oscillator 172 provides oscillations at a high frequency.

A third mode of operation is the ARM state. In the ARM state, the switch 118 in FIG. 13 is closed. This state of operation is similar to the FLASH ARM mode except that it does not occur until the motion sensing switch 114 closes as a result of a movement of the wearer's hold. The ARM mode is initiated by closing the switch 118. When this occurs, the oscillations will be initiated by the closure of the motion sensing switch 114. The time for the production of such oscillations will be reduced relative to the time for the production of the oscillations in the FLASH ARM mode. This results from the fact that the closure of the switch 118 causes the resistor 122 to be connected in parallel with the resistor 126, thereby reducing the time for the capacitor 124 to be charged to a level for resetting the flip-flop 132.

A switch for providing the different modes or operation of the circuitry shown in FIGS. 13 and 14 is generally indicated at 190 in FIG. 16. The switch includes a movable arm 192 and a plurality of stationary contacts 194, 196, 198 and 200. When the movable arm 192 engages the stationary contact 194, the circuitry shown in FIGS. 13 and 14 operates in the FLASH ARM mode. The circuitry shown in FIGS. 13 and 14 operates in the FLASH CONTINUOUS mode when the movable arm 192 engages the stationary contact 196. The circuitry shown in FIGS. 13 and 14 operates in the ARM mode upon an engagement between the movable arm 192 and the stationary contact 198.

When the movable arm 192 engages the stationary contact 200, the circuitry shown in FIGS. 13 and 14 is in the OFF mode. In the OFF mode, a positive voltage is produced on the line 145 in FIG. 14. This voltage is inverted by the amplifier-inverter 142 and the inverted voltage is introduced as a low voltage to the AND network 144 to prevent the oscillators 170 and 172 from operating. The switch 190 may be operated sequentially in successive ones of the different modes by progressive actuations of the movable arm 192 of the switch in FIG. 16.

Figure 2:
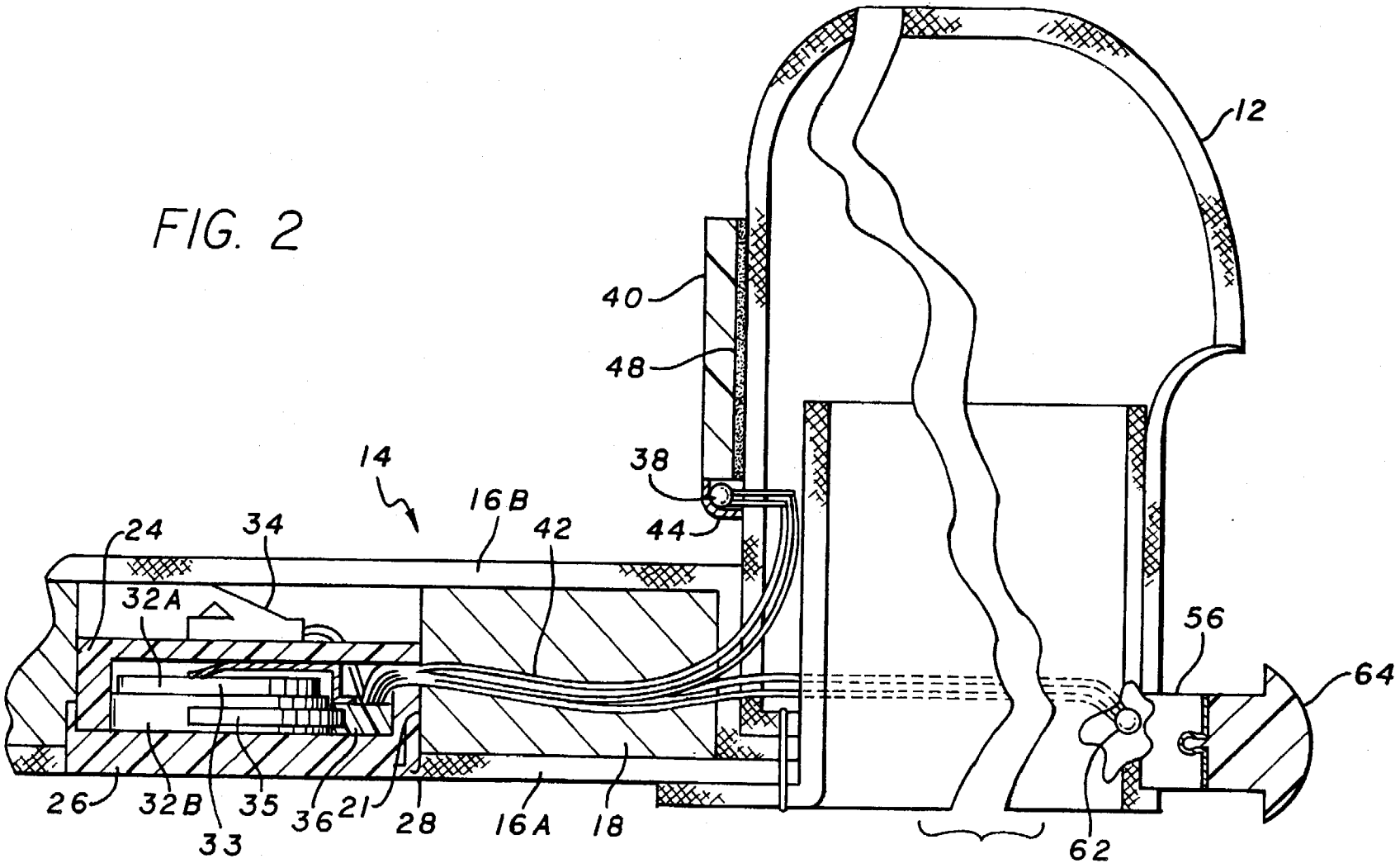
FIG. 2 is a sectional view of the cap and is taken substantially on the line 2—2 of FIG. 6.

The hat or cap 10 has certain important advantages in different embodiments of the invention. In the embodiment shown in FIGS. 1–4, the display member 40 is disposed on the front of the body portion 12 with the body portion having a continuous surface at the front of the body portion. Furthermore, the switch 34 and the module 22 are disposed on the visor 14 in a recessed relationship in the visor to at least partially conceal the module. The switch 34 may be disposed in the module 22 as shown in FIG. 2 or may be displaced from the module as shown in FIG. 3. In either case, the switch 34 may be closed or opened by pressing the top and bottom surfaces of the visor 14 toward each other.

The hat or cap 10 has other significant advantages. For example, the display member 40 may be two dimensional as shown in FIGS. 1, 5 and 6 or may be three dimensional as shown in FIG. 12. The display member 40 may be adhered to the continuous front surface of the hat body 12 as shown at 48 in FIGS. 2 and 3 or may be attached as by the threads 49 in FIG. 11 to the flanges 50 on the display member.

There are other advantages in the hat or cap 10. Another display member 64 may be disposed on the illuminable strap 56 at the rear of the body portion 12. The display member 64 may become illuminated at the same time as the display member 40 as a result of the closure of the switch 34 or it may be independently energized. This arrangement is also advantageous since the straps, when coupled, regulate the size of the body portion 12 so that the body portion will fit snugly on the wearer's head.

Other embodiments also provide additional advantages. For example, the embodiment shown in FIGS. 8–10 provides an automatic closure of the switch 72 when the body portion 12 is disposed on the wearer's head. The embodiment shown in FIG. 12 additionally disposes the light emitting diode 96 in the display member 92.

The embodiment shown in FIGS. 13 and 14 is also advantageous in providing a plurality of modes of operation. For example, the modes may provide for a display by the display member 40 for (a) a particular period of time, (b) a continuous period of time, (c) the renewal of the particular period of time, upon the initiation of the display for the particular period of time, every time that the wearer moves his or her head and (d) for a period of time shorter than the particular period only if and when the wearer moves his or her head.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. In combination in a cap, a body portion, a visor operatively coupled to the body portion, a module disposed on the visor, switching means enclosed by the module and having open and closed positions and normally disposed in the open position and actuatable to the closed position upon depression of the module, electrical circuitry enclosed by the module and connected to the switching means to become energized upon the actuation of the switching means to the closed position, illuminable means disposed on the body portion and electrically connected to the electrical circuitry to become illuminated upon the energizing of the electrical circuitry, display means disposed on the body portion and optically coupled to the illuminable means for providing an illuminated display when the illuminable means becomes illuminated, the module being constructed and disposed on the visor for access to the switching means and the electrical circuitry, the module including a container and a cover operatively coupled to the container and movable between a first position for opening the container and a second position for closing the container, the electrical circuitry and the switching means being disposed within the container, the module being constrainable upon being depressed and the switching means including a spring constrainable in accordance with the constraint imposed upon the module as a result of the depression of the module to actuate the switching means to the closed position.

2. In a combination as recited in claim 1, a printed circuit board for holding the electrical circuitry, the printed circuit board being disposed within the container, and a battery disposed within the container for energizing the electrical circuitry on the printed circuit board when the switching means is closed, the constrainable spring being electrically conductive and establishing an electrical continuity with the battery when the spring is constrained.

3. In combination in a cap, a body portion, a visor operatively coupled to the body portion, a module disposed on the visor, switching means enclosed by the module and having open and closed positions and normally disposed in the open position and actuatable to the closed position upon a depression of the module, electrical circuitry enclosed by the module and connected to the switching means to become energized upon the actuation of the switching means to the closed position, illuminable means disposed on the body portion and electrically connected to the electrical circuitry to become illuminated upon the energizing of the electrical circuitry, display means disposed on the body portion and optically coupled to the illuminable means for providing an illuminated display when the illuminable means becomes illuminated, the module being constructed and disposed on the visor for access to the switching means and the electrical circuitry, the visor having top and bottom layers, a backing member disposed between the top and bottom layers of the visor, there being apertures in the bottom layer of the visor and in the backing member to receive the module in a recessed relationship within the layer, the module including a container and a cover operatively coupled to the container and movable between a first position for opening the container and a second position for closing the container, the electrical circuitry and the switching means being disposed within the container, a printed circuit board for holding the electrical circuitry, the printed circuit board being disposed within the container, and a battery disposed within the container for energizing the electrical circuitry on the printed circuit board when the switching means is closed, the module being constrainable upon becoming depressed and the switching means including a spring constrainable in accordance with the constraint upon the module as a result of a depression of the module.

4. In combination in a cap, a body portion having inner and outer surfaces, a visor extending from the body portion, switching means supported by the visor and having open and closed states and normally operative in the open state and actuatable to the closed state, a battery supported by the visor, first means at least partially disposed on the body portion and responsive to the closure of the switching means for providing an illumination, display means optically coupled to the first means and disposed on the body portion for providing an illuminated display when the first means becomes illuminated, the first means being disposed relative to the display means to provide an edge illumination of the display means, a module supported by the visor, the switching means and the battery being disposed in the module and the switching means being constructed to become closed upon a depression of the visor, the display means constituting a first display means, the body portion having a front and a rear, the first display means being disposed on the front of the body portion, second means disposed on the rear of the body portion and responsive to the closure of the switching means for providing an illumination, and second display means optically coupled to the second means and disposed on the rear of the body portion for providing a second display, the second means being disposed relative to the second display means to provide an edge illumination of the second display means.

5. In combination in a hat, a body portion having front and rear ends and separated at its rear end into two (2) separate sections, a pair of straps each disposed on an individual one of the separate sections and constructed for coupling to the other one of the straps to move the separate sections together, switching means having open and closed states and normally operative in the open state and actuatable to the closed state when the body portion is disposed on a wearer's head, illuminating means, first means responsive to the closure of the switching means for providing an illumination by the illuminating means, second means disposed relative to a particular one of the straps for passing the illumination from the illuminating means to such particular strap, the particular one of the straps being constructed to pass the illumination from the first means, display means optically coupled to the particular one of the straps for receiving the illumination from the particular one of the straps and for becoming illuminated by such illumination from the particular one of the straps to provide an illuminated display, the body portion having a front, third means disposed on the front of the body portion for providing an illumination, the display means constituting first display means, and second display means disposed on the front of the body portion and optically coupled to the second means for receiving the illumination from the second means and for becoming illuminated by such illumination to provide an illuminated display, one of the straps having a plurality of male detents progressively disposed along the length of the strap and the other strap having a plurality of female detents progressively disposed along the length of the strap for providing a selective coupling between the male and female detents to move the sections together, a visor coupled to the front end of the body portion, a backing member disposed within the visor, a module retained by the backing member, and a battery for energizing the first means, and the battery and the switching means being disposed within the module.

6. In combination in a hat, a body portion having front and rear ends and separated at its rear end into two (2) separate sections, a pair of straps each disposed on an individual one of the separate sections and constructed for coupling to the other one of the straps to move the separate sections together, switching means having open and closed states and normally operative in the open state and actuatable to the closed state when the body portion is disposed on a wearer's head, illuminating means, first means responsive to the closure of the switching means for providing an illumination by the illuminating means, second means disposed relative to a particular one of the straps for passing the illumination from the illuminating means to such particular strap, the particular one of the straps being constructed to pass the illumination from the first means, and display means optically coupled to the particular one of the straps for receiving the illumination from the particular one of the straps and for becoming illuminated by such illumination from the particular one of the straps to provide an illuminated display, the body portion having a front, third means disposed on the front of the body portion for providing an illumination, the display means constituting first display means, and second display means disposed on the front of the body portion and optically coupled to the second means for receiving the illumination from the second means and for becoming illuminated by such illumination to provide an illuminated display, one of the straps having at least one male detent and the other strap having at least one female detent for providing a coupling between the straps to move the sections together, the particular one of the straps being disposed relative to the first display means and being constructed to provide an edge effect illumination of the first display means, third means disposed relative to the second display means and constructed to provide an edge effect illumination of the second display means, the hat having a visor coupled to the body portion, the display means constituting first display means, the switching means being supported by the visor, a battery, a module supported by the visor and enclosing the switching means and the battery for actuating the switching means to the closed state in accordance with a depression of the module, the module being disposed relative to the visor to become depressed upon a depression of the visor, second means disposed on the front of the body portion and responsive to the closure of the switching means for providing an illumination, and second display means disposed on the front of the body portion and optically coupled to the second means for receiving the light from the second means and for becoming illuminated by such light to provide an illuminated display.

7. In combination in a hat, switching means disposed on the hat and having open and closed states and normally operative in the open state and operable to the closed state, a body portion having a front continuous exterior surface, illuminating means operatively coupled to the switching means and disposed on the body portion for becoming illuminated upon the closure of the switching means, display means disposed on the front continuous exterior surface of the body portion and optically coupled to the illuminating means for providing an illuminated display when the illuminating means becomes illuminated, and means for securing the display means to the front continuous exterior surface of the hat, the illuminating means being disposed on the front continuous exterior surface of the body portion and having an edge effect optical coupling to the display means at the front continuous exterior surface of the body portion, a visor, energizing means operatively coupled to the switching means for becoming energized upon the closure of the switching means and for illuminating the illuminating means upon becoming energized, the module being disposed within the visor in a position shielding the module from view when the hat is disposed on a wearer's head, the energizing means being enclosed within the module with the battery and the switching means.

8. In combination in a hat, switching means disposed on the hat and having open and closed states and normally operative in the open state and operable to the closed state, a body portion having a front continuous exterior surface, illuminating means operatively coupled to the switching means and disposed on the body portion for becoming illuminated upon the closure of the switching means, display means disposed on the front continuous exterior surface of the body portion and optically coupled to the illuminating means for providing an illuminated display when the illuminating means becomes illuminated, and means for securing the display means to the front continuous exterior surface of the hat, the illuminating means being disposed on the front continuous exterior surface of the body portion and having an edge effect optical coupling to the display means at the front continuous exterior surface of the body portion, a visor coupled to the body portion, a module supported by the visor, energizing means operatively coupled to the switching means for becoming energized upon the closure of the switching means and for illuminating the illuminating means upon becoming illuminated, the energizing means and the switching means being disposed in the module, the module being disposed relative to the visor to become depressed upon the depression of the visor and the switching means being disposed in the module relative to the module and the visor and being constructed to become operative in the closed state upon the depression of the visor.

9. In combination in a hat, switching means disposed on the hat and having open and closed states and normally operative in the open state and operable to the closed state, a body portion having a front continuous exterior surface, illuminating means operatively coupled to the switching means and disposed on the body portion for becoming illuminated upon the closure of the switching means, display means disposed on the front continuous exterior surface of the body portion and optically coupled to the illuminating means for providing an illuminated display when the illuminating means becomes illuminated, means for securing the display means to the front continuous exterior surface of the hat, a visor coupled to the body portion and having top and bottom layers, a module, a backing member disposed in the visor between the top and bottom layers and constructed to support the module between the top and bottom layers, a battery, and energizing means operatively coupled to the switching means for becoming energized upon the closure of the switching means, the battery, the switching means and the energizing means being disposed within the module.

10. In a combination as recited in claim 9, the module being constrainable, the switching means including a member constrainable in accordance with the constraints imposed upon the module to operate the switching means to the closed states.

11. In combination in a hat, switching means disposed on the hat and having open and closed states and normally operative in the open state and operable to the closed state, a body portion having a front continuous exterior surface, illuminating means operatively coupled to the switching means and disposed on the body portion for becoming illuminated upon the closure of the switching means, display means disposed on the front continuous exterior surface of the body portion and optically coupled to the illuminating means for providing an illuminated display when the illuminating means becomes illuminated, and means for securing the display means to the front continuous exterior surface of the hat, a visor coupled to the body portion, a module supported by the visor, and energizing means operatively coupled to the switching means for becoming energized upon the closure of the switching means and for illuminating the illuminating means upon becoming illuminated, the energizing means and the switching means being disposed in the module, the module being disposed relative to the visor and the switching means being disposed in the module relative to the module and the visor and being constructed to become operative in the closed state upon the depression of the visor.

* * * * *